United States Patent [19]

Bundy

[11] Patent Number: 4,841,836

[45] Date of Patent: Jun. 27, 1989

[54] THERMAL SHROUD FOR A GUN TUBE

[76] Inventor: Mark L. Bundy, 1265 Allison Ct., Belcamp, Md. 21017

[21] Appl. No.: 115,958

[22] Filed: Nov. 2, 1987

[51] Int. Cl.[4] ..... F41F 17/14

[52] U.S. Cl. ..... 89/14.1; 89/15

[58] Field of Search ..... 89/14.1, 15, 16

[56] References Cited

U.S. PATENT DOCUMENTS

| | | | |
|---|---|---|---|
| 2,112,144 | 3/1938 | Coupland | 89/14.1 |
| 2,287,066 | 6/1942 | Rodgers | 89/14.1 |
| 2,337,840 | 12/1943 | Scott-Paine et al. | 89/14.1 |
| 4,346,643 | 8/1982 | Taylor et al. | 89/14.1 |
| 4,638,713 | 1/1987 | Milne et al. | 89/14.1 |
| 4,753,154 | 6/1988 | Higashi | 89/14.1 |
| 4,762,048 | 8/1988 | Higashi et al. | 89/14.1 |

FOREIGN PATENT DOCUMENTS

| | | | |
|---|---|---|---|
| 0033770 | 8/1981 | European Pat. Off. | 89/14.1 |
| 0089687 | 5/1985 | Japan | 89/14.1 |

OTHER PUBLICATIONS

Gloster Saro, Ltd., Gloucester, England; Brouchure entitled "Gun Barrel Insulation", 10/87.

*Primary Examiner*—Deborah L. Kyle
*Assistant Examiner*—Daniel Wasil

[57] ABSTRACT

A gun tube thermal shroud for reducing temperature gradients across the gun tube caused by asymmetric external and internal heat flux distributions, which includes an inner layer of high thermal conductivity extending about and along the gun tube in intimate thermal contact with the gun tube. In the preferred embodiment, this inner layer is formed of aluminum wire which is tightly wound about the gun tube and which is embedded in a thermally conductive flexible adhesive. The shroud also includes a middle layer of thermal insulating material and an outer layer of high thermal conductivity material, which may be formed in the same manner as the inner layer.

15 Claims, 9 Drawing Sheets

THERMAL SHROUD FOR A GUN TUBE

RIGHTS OF THE GOVERNMENT

The invention described herein may be manufactured, used and licensed by and for the United States Government for Governmental purposes without payment to me of any royalties thereon.

BACKGROUND OF THE INVENTION

The invention relates generally to thermal shrouds for gun tubes and, in particular, to a thermal shroud for minimizing a temperature gradient across a gun tube due to both internal and external heat flux asymmetries.

In rapid fire small arms, such as machine guns, it is often necessary to use a cooling system or apparatus to remove heat from the gun barrel caused by rapid firing of the weapon. One method of removing this internally generated heat is to surround the gun barrel with a thermally conductive material, such as aluminum, in intimate thermal contact with the gun barrel, to distribute this heat both axially and radially, and to provide a large exterior surface for radiating this heat to air passing over this surface. Examples of such cooling apparatus are described in U.S. Pat. No. 2,112,144, issued Mar. 22, 1938 to Coupland, and in U.S. Pat. No. 2,337,840, issued Dec. 28, 1943 to Scott-Paine et al.

In larger guns, such as tank cannons, temperature gradients across the tube due to external heat flux asymmetries, such as uneven heating caused by solar or ground radiation, or uneven cooling caused by rain, sleet, or wind, can cause slight bending of the gun tube which contributes to aiming inaccuracy. All successful thermal shrouds for minimizing the temperature gradient across the gun tube due to external heat flux asymmetries utilize one of two design principles. One method is to azimuthally disburse the gradient by using a thermally conductive outer shroud layer. The other method is to thermally shield the barrel from external temperature gradients by providing adequate radial insulation between the gun tube and the outer shroud surface. For example, the heat pipe jacket described in U.S. Pat. No. 4,346,643, issued Aug. 31, 1982 to Taylor et al, employs conductive dissipation while the thermal sleeve described in U.S. Pat. No. 4,638,713, issued Jan. 27, 1988 to Milne et al, relies on radial insulation. Some designs, such as the BRL thermal jacket shown in FIG. 3 herein, employ both mechanisms by alternating thermal insulating and conducting layers.

Conventional shrouds which thermally insulate the barrel from external temperature gradients have some type of thermal insulation, such as thermal insulating material or a closed air space, adjacent to the gun barrel. While this layer of insulation protects the barrel from the influence of temperature gradients at the shroud outer surface, it does not help dissipate barrel temperature gradients generated internally from gunfire.

Also, in conventional shrouds which azimuthally disperse a temperature gradient across a gun tube by the use of a thermally conductive layer extending about and along the tube, this thermally conductive layer is usually formed as a cylindrical element of solid metal. Thus, any temperature difference across this solid metal layer due to an asymmetric heat flux will exert some bending force on the gun tube.

SUMMARY OF THE INVENTION

It is an object of the invention to provide a thermal shroud for a gun tube for minimizing the temperature gradient across the gun tube due to both internal and external heat flux asymmetries.

It is another object of the invention to provide a gun tube thermal shroud which includes a layer of thermally conductive material in intimate thermal contact with the gun barrel, which the thermal conductivity of this layer in a circumferential direction about the periphery of the gun barrel is greater than the thermal conductivity of this layer in an axial direction along the gun barrel axis.

It is a further object of the invention to provide a gun tube thermal shroud having a thermally conductive layer in intimate thermal contact with the gun barrel, in which this layer includes metallic material and flexible adhesive material disposed so as to minimize the bending stress on the gun barrel due to temperature gradient across this layer.

It is still another object of the invention to provide a gun tube thermal shroud which includes a thermally conductive layer in intimate thermal contact of the gun barrel to reduce temperature gradients caused by gun fire, in which this layer extends for the entire length of the barrel, including the region of the barrel under a bore evacuator.

It is still further object of the invention to provide a gun tube thermal shroud having two layers of thermally conductive material separated by a layer of thermally insulating material, in which thermally conductive and non-conductive adhesives are utilized to permanently affix the thermal shroud on the gun tube, without the use of clamps, straps, or threaded nuts.

The preferred embodiment of the invention includes an inner layer of thermally conductive material in intimate contact with the gun barrel, an intermediate layer of thermally non-conductive material, and an outer layer of thermally conductive material.

The inner layer is formed of aluminum wire, which is tightly wound about the entire gun barrel, including that portion of the barrel underneath the bore evacuator, and which is embedded in a thermally conductive flexible adhesive for maintaining intimate thermal contact between the wire and the barrel, and for permanently affixing the aluminum wire to the gun barrel. This type of construction of the inner layer minimizes the bending force exerted on the gun tube due to temperature gradients across the inner layer, as described in more detail below.

The middle layer of insulation is composed of a flexible, thermally nonconductive adhesive.

The outer layer is formed of aluminum wire embedded in a thermally conductive flexible adhesive and tightly wrapped about the middle layer, in the same manner as the inner layer.

BRIEF DESCRIPTION OF THE DRAWINGS

The invention will be better understood, and further objects, features, and advantages thereof will become more apparent from the following detailed description of the preferred embodiment taken in conjuction with the drawings in which.

DESCRIPTION OF PREFERRED EMBODIMENTS

Figure 1:
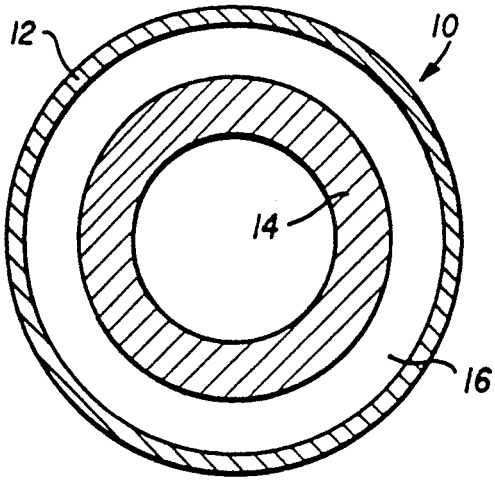
FIG. 1 (PRIOR ART)
FIG. 1 is a schematic cross section view of a first conventional 120 mm thermal shroud which uses conductive dissipation.

The thermal shroud 10 shown in FIG. 1 includes an aluminum tubular member 12 having an average thickness of about 5 mm, which is disposed concentrically about a gun barrel 14. This tubular member 12 azimuthally disperses an external temperature gradient generated at the outer surface of the shroud by solar radiation, precipitation, wind, or the like. The tubular member 12 is thermally insulated from the gun barrel 14 by an annular air space 16 having an average radial thickness of approximately 8 mm.

Figure 2:
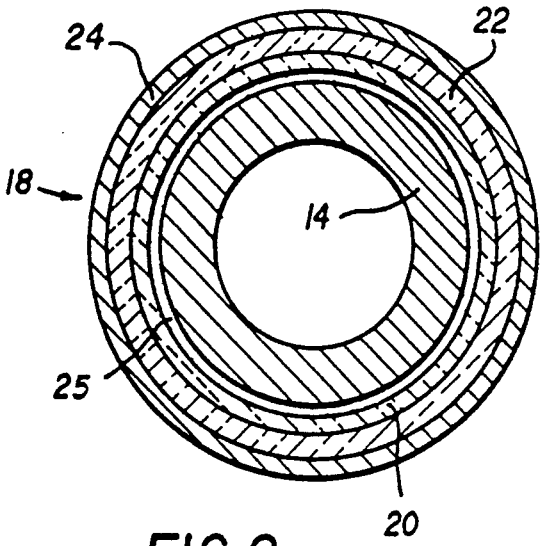
FIG. 2 (PRIOR ART)
FIG. 2 is a schematic cross section view of a second conventional 120 mm thermal shroud which uses radial insulation.

The thermal shroud 18 shown in FIG. 2 relies solely on radial insulation to thermally shield the gun barrel 14 from external temperature gradients at the shroud outer surface. This shroud 18 is approximately 14 mm thick, and includes an inner layer 20 of fiberglass, a middle layer 22 of porous insulating material, and an outer layer 24 of fiberglass. The inner fiberglass layer 20 is concentrically spaced from the gun barrel 14 by an annular air gap 25 having a radial thickness of approximately 1 mm adjacent the muzzle.

Figure 3:
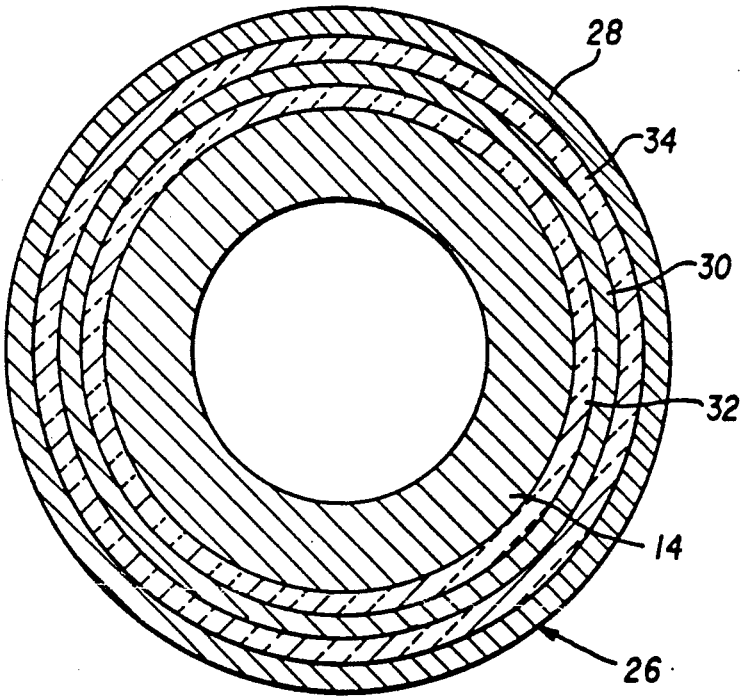
FIG. 3 (PRIOR ART)
FIG. 3 is a schematic cross section view of the BRL thermal jacket design which uses both conductive dissipation and radial insulation.

The thermal shroud 26 shown in FIG. 3 employs both conductive dissipation and radial insulation to minimize the temperature across the gun barrel 14 due to external heat flux asymmetries. This shroud 26 consists of alternate layers of thermally conductive and nonconductive materials. It includes an outer layer 28 and a first intermediate layer 30 of aluminum, each having a radial thickness at approximately 0.5 mm. It also includes an inner layer 32 and a second intermediate layer 34 of fiberglass, each having a radial thickness of approximately 13 mm.

Figure 4:
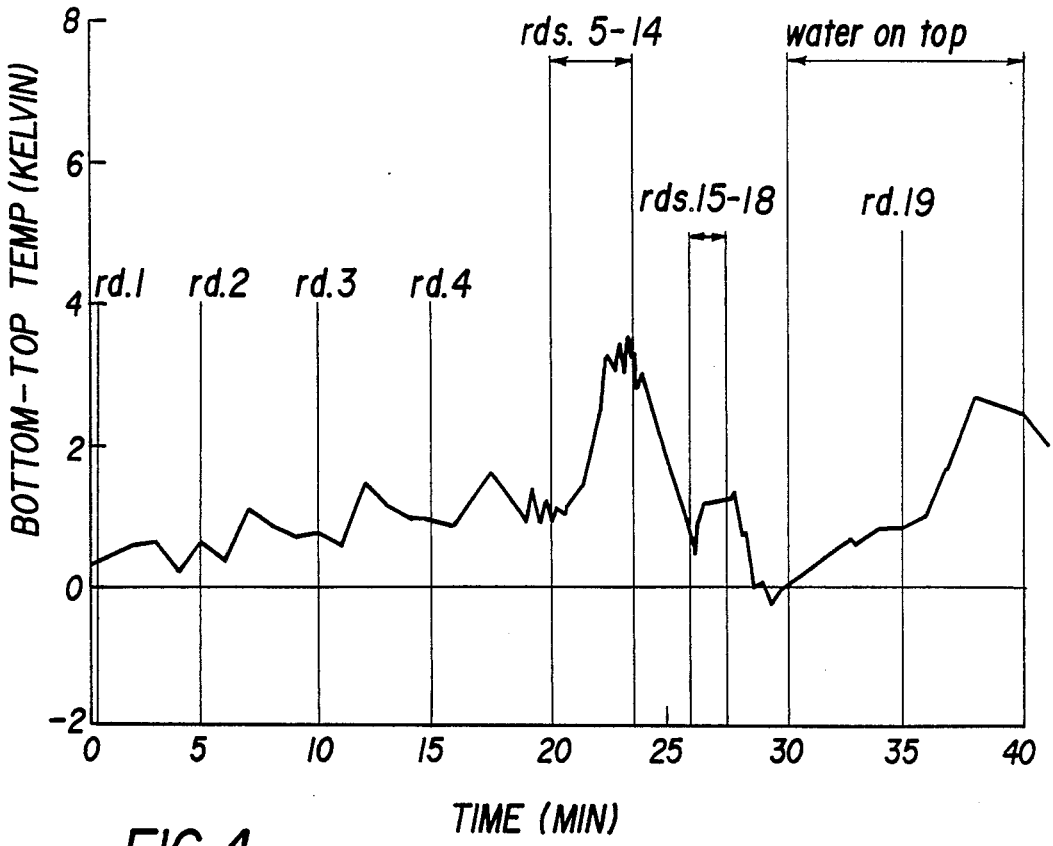
FIG. 4 is a graph of the firing induced top-to-bottom temperature difference under the shroud of FIG. 1 at one meter from the muzzle versus time.

All three of the gun tube thermal shrouds shown in FIGS. 1–3 have some type of thermal insulation adjacent the gun barrel. This layer of insulation protects the barrel from the influence of temperature gradients on the shroud outer layer, but does not help dissipate barrel temperature gradients generated internally from gun fire. For example, FIG. 4 plots the firing induced temperature difference measured under the thermal shroud shown in FIG. 1 at one meter from the muzzle as a function of time. (Nineteen rounds were fired during a forty minute test period. During the last ten minutes of this test, simulated rain at a rate of six inches per hour was applied by a soaking hose suspended above the gun tube.) As shown in FIG. 4, the bottom of the gun tube is hotter than the top, with the magnitude of this gradient depending on the rate of fire. This temperature gradient may arise from friction itself or from friction induced changes in the bore's thermal surface layer, as the projectile is forced to follow the combined static and dynamic curvature of the bore centerline. The bore's thermal surface layer consists of propellant residue, crack embedded oxides, and a heat hardened zone, all of which affect the propellant heat transfer to the barrel. The temperature difference spike which occurs after each shot in FIG. 4 is approximately ten percent of the average barrel temperature spike after each shot. Thus, a ten percent asymmetry in the heat influx to the barrel on each shot is sufficient to account for the observed firing induced temperature gradient.

Figure 5:
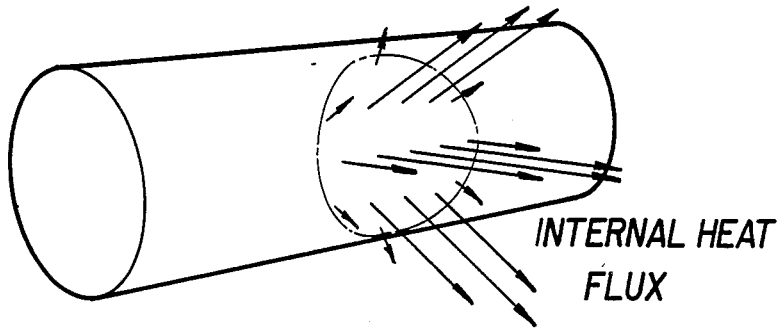
FIG. 5 is schematic of the heat influx profile on the inner bore surface, used to model a firing induced hot spot on the gun barrel.
Figure 6:
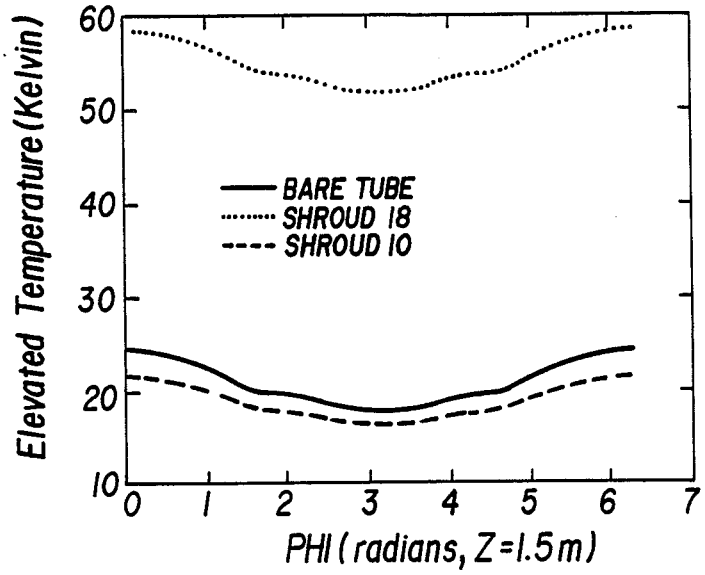
FIG. 6 is a graph showing the predicted temperature distribution around the gun tube, due to a gun tube hot spot centered arbitrarily at an axial distance Z of 1.5 m. from one end of a 3.0 m. tube and an angular displacement PHI of 0.0 radians.
Figure 7:
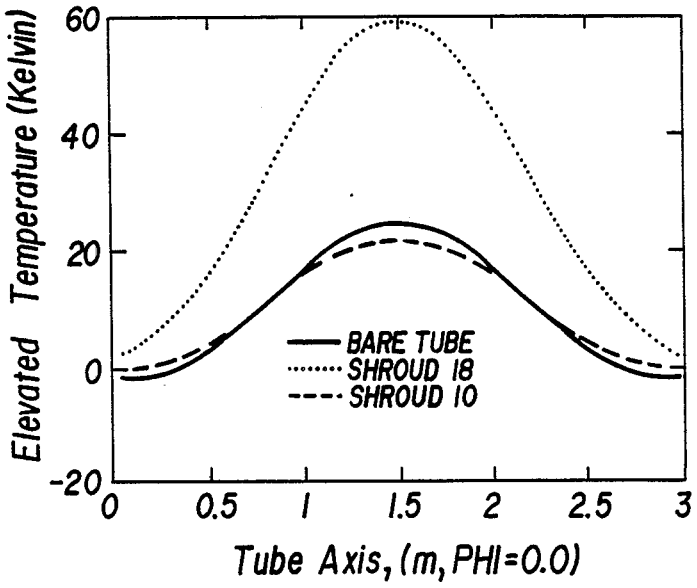
FIG. 7 is a graph of the predicted temperature distribution along the gun tube, due to the gun tube hot spot of FIG. 6.

During rapid fire test sequences performed on a 120 mm cannon utilizing the thermal shroud 10 of FIG. 1 and the thermal 18 of FIG. 2, the gun tube with shroud 18 elevated in comparison to the gun tube with shroud 10, even after compensating for changes in the recoil mount. Although the shroud-to-gun clearance 25 prevented direct thermal couple measurements on the gun tube, such as those used to produce FIG. 4, it can be speculated that the increased insulation properties of shroud 18 produce greater top-to-bottom temperatures than those for shroud 10. As a consequence, a gun barrel with shroud 18 would yield a greater upward curvature of the gun tube. To investigate this conjecture, a theoretical three-dimensional steady state heat transfer model was formulated to model the thermal distortion effect of an internal "hot spot" on the gun barrel for various shroud design. In this model, a thermal conductivity of 0.05 watts per meter per degree Centigrade was assumed for the three insulating layers 20, 22, 24 of the thermal shroud 18 shown in FIG. 2. FIG. 5 is a schematic of the heat influx to the bore surface used to model a firing induced hot spot. FIGS. 6 and 7 are plots of the predicted temperature distribution along and around the gun tube axis through the center of the hot spot. As conjectured, the predicted cross tube temperature gradient is increased under shroud 18 and is only slightly diminished under shroud 10, in comparison to the bare tube case.

Figure 8:
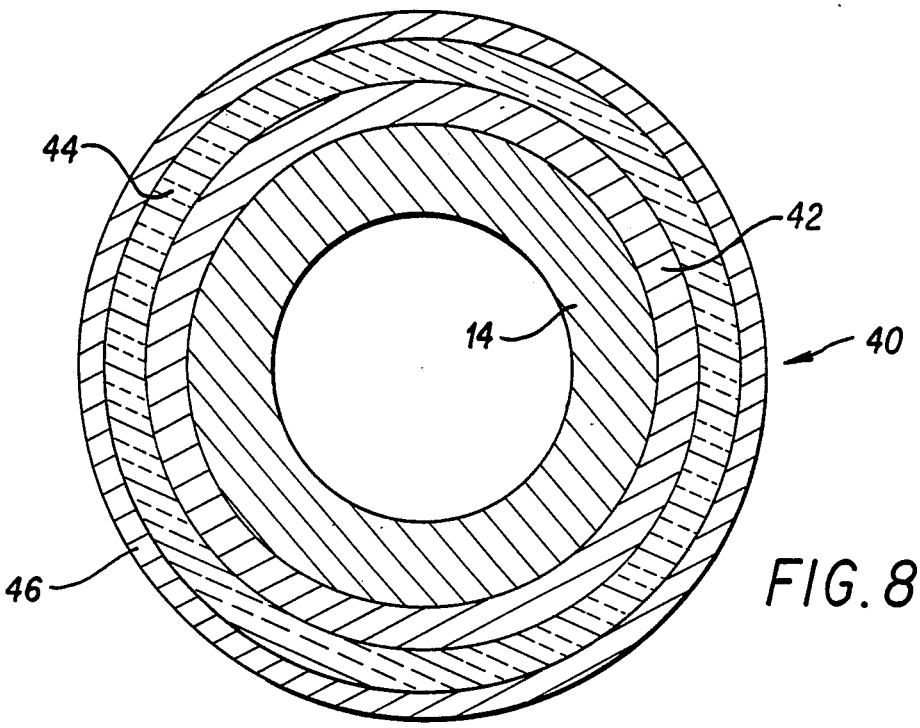
FIG. 8 is a schematic cross section of the prefered embodiment of the invention.
Figure 9:
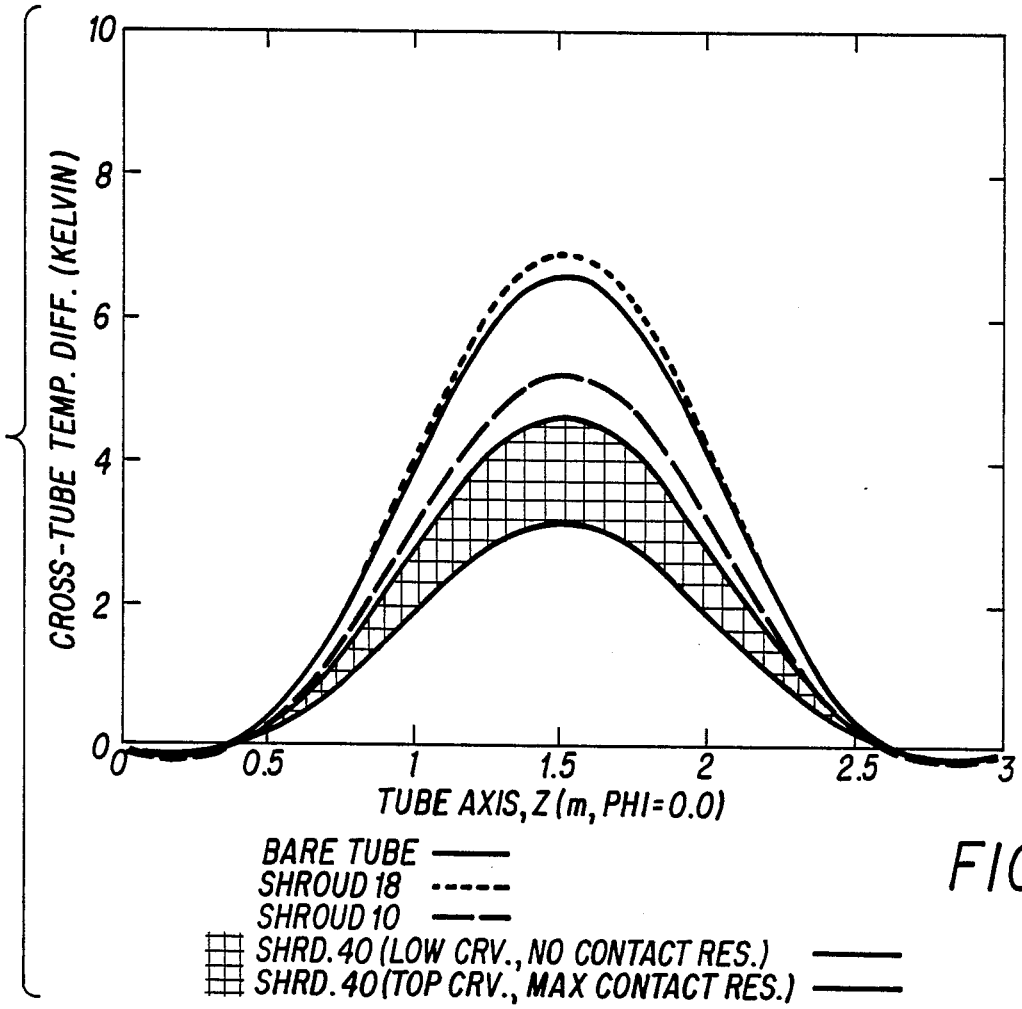
FIG. 9 is a graph of the predicted cross-tube temperature difference along a gun tube for a bare tube, and tubes using the thermal shrouds shown in FIGS. 1, 2, and 8.

The preferred embodiment of the invention, thermal shroud 40, is shown in FIG. 8. This shroud 40 includes a inner layer 42 of high thermal conductivity material which extends about and along the gun tube 14 in intimate thermal contact with the gun tube, middel layer 44 of thermal insulation material which extends about and along the inner layer 42 and outer layer 46 of high thermal conductivity material which extends about and along the middle layer 44.

There are four major sources of heat flux asymmetric which a thermal shroud should dissipate, namely, sun, rain, free air convection about the hot tube or shroud, and firing induced hot spots. Conventional shrouds such as shown in FIGS. 1–3 for minimizing the first three external heat flux asymmetries fail to minimize distortion of the gun tube caused by firing. The new shroud design shown in FIG. 8 will minimize the distortion effect from all four heat flux sources. The rationale for this new shroud design is as follows:

(a) The inner layer 42 disburses, via thermal conduction, both internal firing produced temperature gradients and any external temperature gradients which filter through the outer two layers 44, 46.

(b) The middle layer 44 provides a thermal barrier which:

(1) reduces the temperature of the outer shroud when firing, which in turn reduces the infrared (countermeasure) signature from the hot gun tube and reduces the magnitude of free air convection around the shroud, and thus the vertical temperature gradient caused by such convection;

(2) reduces the influence of external induced temperature gradients; and (3) provides structural support for the thin aluminum outer layer; and (c) The outer layer 46 reduces weather induced temperature differences and the thermal countermeasure signature of solar radiation by virtue of its circumferential thermal conductivity.

The materials and exact thickness of each layer 42, 44, 46 was chosen, based on theoretical predictions, to provide the optimum thermal distortion protection for a given shroud weight.

Figure 13:
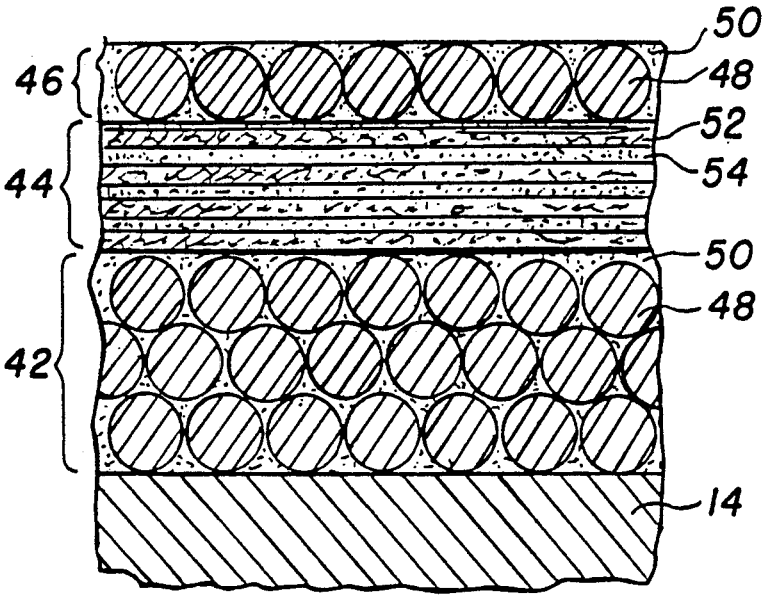
FIG. 13 is a partial sectional schematic view of a portion of the preferred embodiment, taken along the line 13—13 of FIG. 8.

Referring to FIG. 13, the inner layer 42 is approximately 6 mm thick, and is formed by tightly wrapping three layers of number 12 gauge aluminum wire 48 around the gun barrel along its entire length, including the portion of the barrel under the bore evacuator. The aluminum wire 48 is embedded in a commercially available, thermally conductive, flexible adhesive 50, such as Dow Corning Sylgard 3-6605 thermally conductive elastimer, which maintains intimate thermal contact between the aluminum wire 48 and the gun barrel 14. The aluminum wire 48 can be coated with elastimer 50 before or during the winding process, so that each turn of aluminum wire is separated from any adjacent turn of aluminum wire by the flexible elastimer 50.

The middle layer 44 is approximately 3 mm thick and is formed by wrapping four layers of fiberglass cloth 52 about the inner layer 42. The fiberglass is embedded in a commercially available, flexible, thermally non-conductive adhesive 54, such as Dow Corning Sylgard 577 insulating self-priming adhesive.

The outer layer 46 is approximately 2 mm thick and is formed by wrapping No. 8 gauge aluminum wire 48 tightly about the middle layer 44 along the entire length of the gun barrel 14, including the portion of the barrel under the bore evacuator. This aluminum wire 48 is also embedded in a commercially available thermally conductive flexible adhesive 50 in the same manner as the inner layer 42, so that this outer layer 46 firmly adheres to the middle layer 44.

Figure 10:
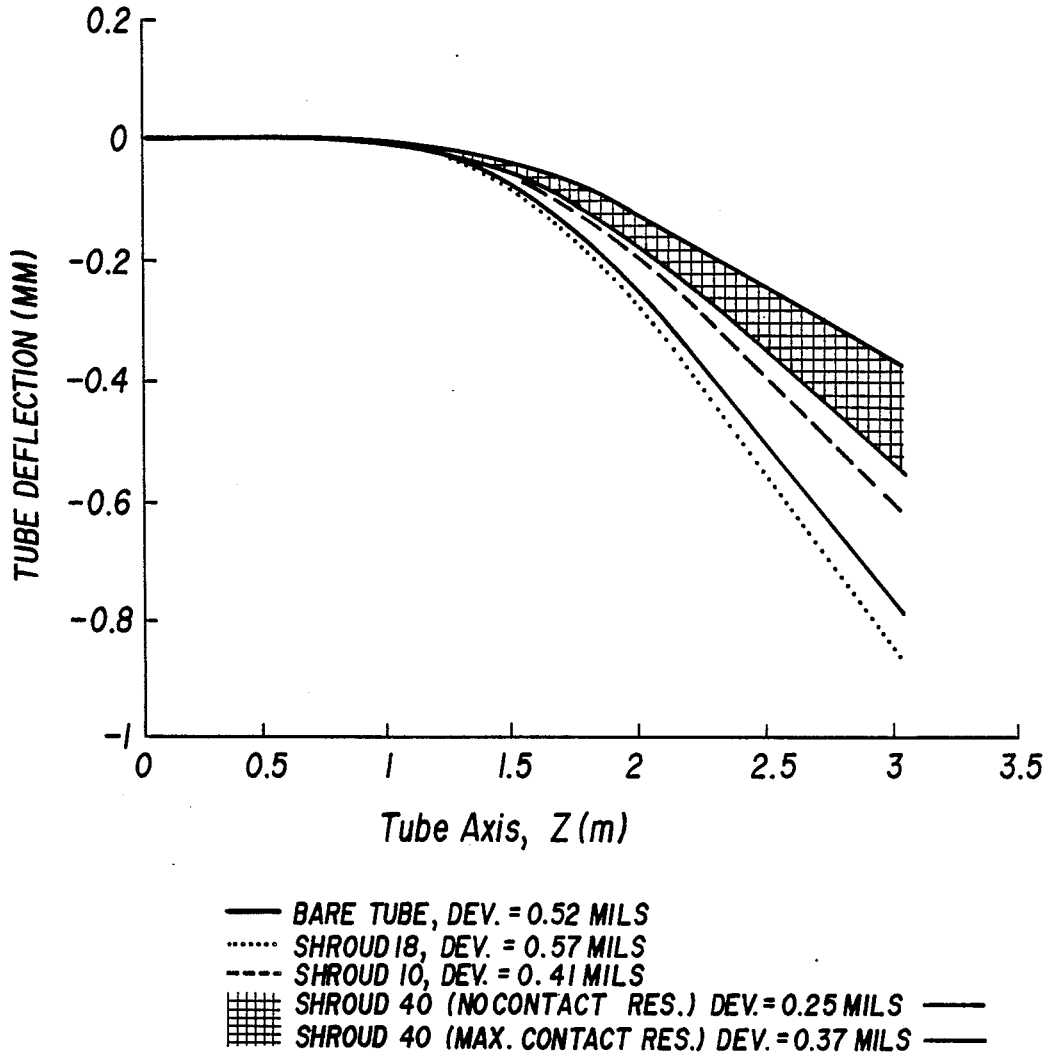
FIG. 10 is graph of the predicted tube deflection due to the hot spot of FIG. 6 for a bare tube and for tubes using the thermal shrouds shown in FIGS. 1, 2, and 8.
Figure 11:
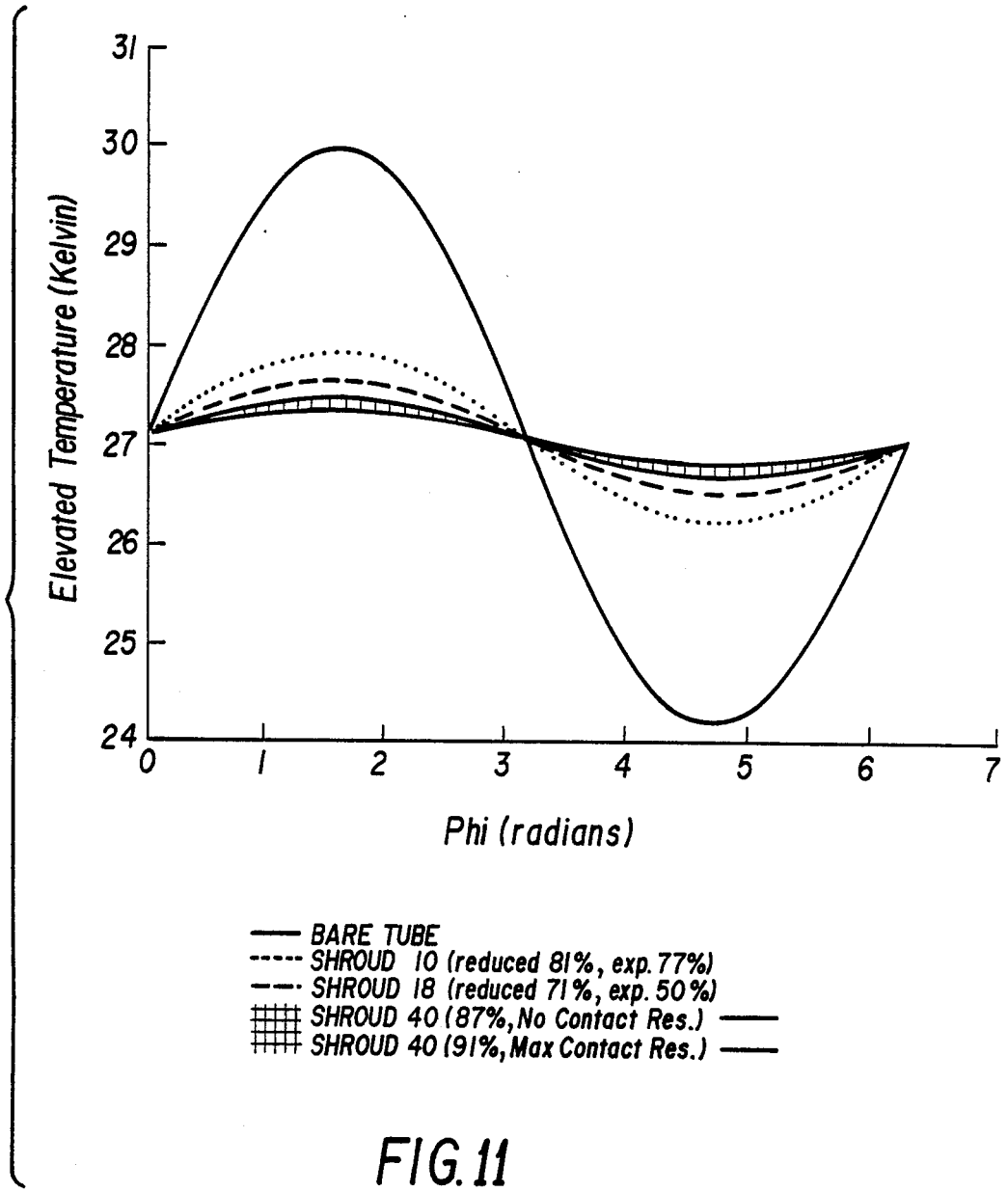
FIG. 11 is a graph of the predicted temperature distribution about a gun tube due to solar radiation at PHI=1.57 radians for a bare tube, and for tubes using the thermal shrouds shown in FIGS. 1, 2, and 8.
Figure 12:
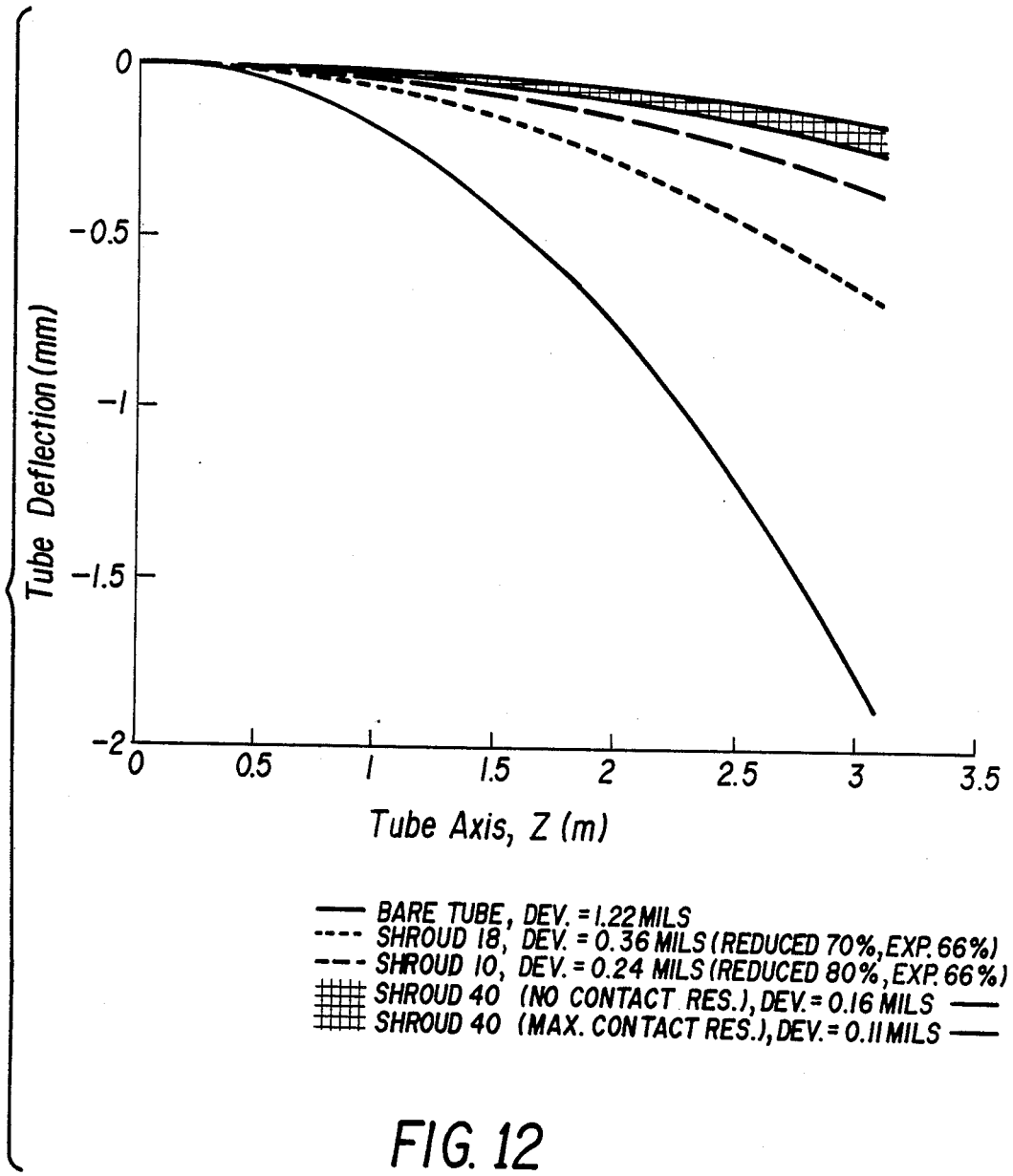
FIG. 12 is a graph of the predicted tube deflection due to solar radiation for a bare gun tube and for tubes using the thermal shrouds shown in FIGS. 1, 2, and 8.

In FIGS. 9–12, the predicted thermal protection of the new shroud 40 is compared against the predicted values for the conventional shrouds 10 and 18. Even with a maximum thermal contact resistance between the shroud and the gun barrel (equivalent to 0.2 mm air gap between the aluminum wire and the steel of the gun barrel) the new design shows better dissipation performance than either of the other two shrouds 10, 18 for both externally and internally generated heat flux asymmetries. For example, as shown in FIG. 10, the new shroud 40 will reduce hot spot distortion two times better than shroud 10 and five times better than shroud 18. As shown in FIG. 11, the shroud 40 will reduce simulated solar temperature gradients ten percent better than shroud 10 and twenty percent better than shroud 18.

Figure 14:
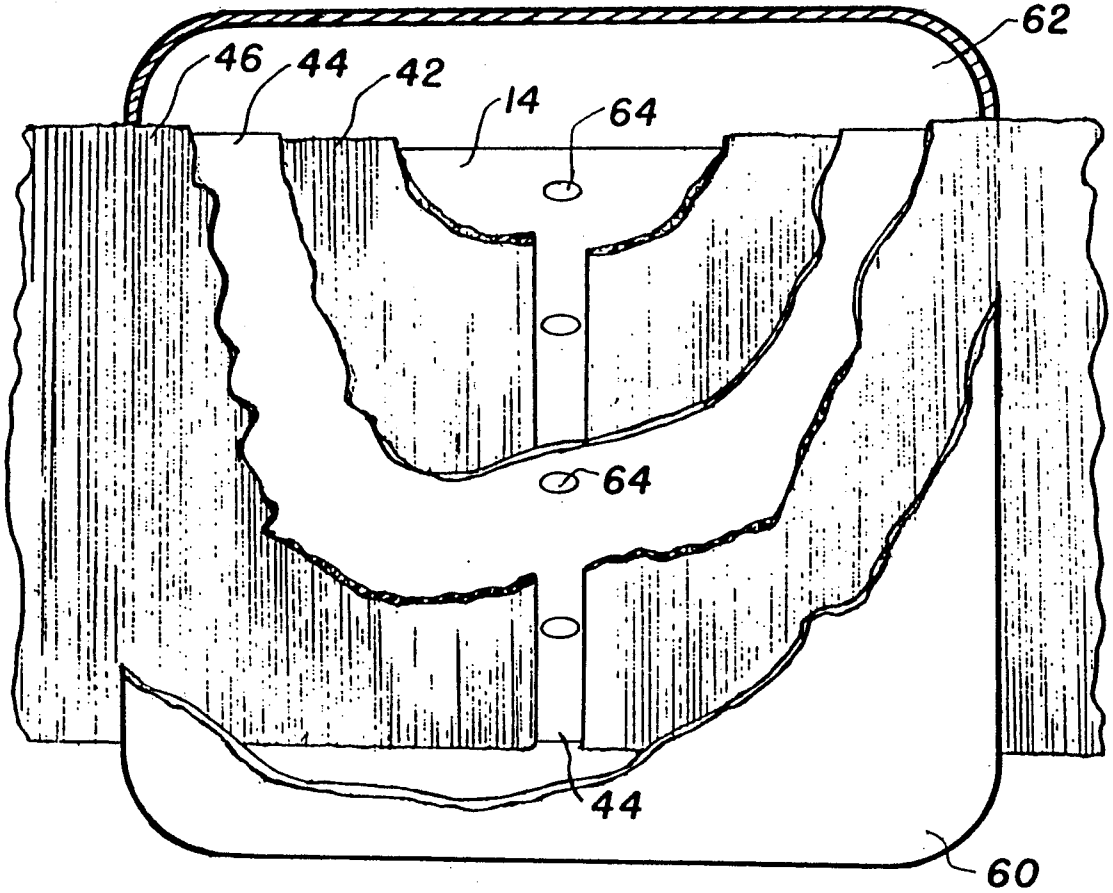
FIG. 14 is a longitudinal fragmented sectional view of a portion of the gun tube and thermal shroud, according to the invention, beneath a gun bore evacuator.

Most large guns include a bore evacuator 60 including an annular plenum 62 which is disposed about a central portion of the gun barrel 14 and which is connected to the gun bore by a plurality of bore exhaust ports 64 extending through the gun barrel 14, as illustrated in FIG. 14. Conventional gun shrouds do not extend over the portion of the gun barrel under the bore evacuator plenum 62. However, the new shroud 40 extends along the entire length of the gun barrel, including the portion under the bore evacuator plenum 62, with bore exhaust ports 64 extending through the three layers 42,44,46 of the shroud 40.

Unlike these conventional shrouds, the new shroud 40 will provide thermal distortion protection under the the bore evacuator 60 as well as over the exposed portions of the gun barrel. Having the shroud 40 under the bore evacuator will reduce any firing induced distortion of the tube 14 due to a non-uniform distribution of hot gases in the bore evacuator region. The volume reduction of the evacuator space 62 due to the 11 mm thickness of the shroud 40 will be minimal.

By using thermally conductive and nonconductive flexible adhesives to permanently affix the thermal shroud 40 on the gun tube 14, the new shroud 40 will require less maintenance than conventional shrouds a which utilize clamps, straps or threaded nuts to secure the shrouds to the gun barrel.

If the inner and outer layers 42, 46 were formed of solid aluminum, the new shroud 42 should still offer better overall protection against both internal and external heat flux asymmetries. However, the use of closely spaced, tightly wound aluminum wire 48 embedded in a thermally conductive flexible adhesive 50 to form the inner and outer layers 42, 46 minimizes any bending force on the gun barrel 14 caused by asymmetric thermal expansion or contraction of these layers 42, 46. The flexible adhesive 50 allows asymmetric expansion or contraction of the aluminum wire 48 without producing a bending force on the gun barrel. Also, since the thermal conductivity of the aluminum wire (200 watts per meter per degree Centigrade) is greater than that of the flexible adhesive (1.04 watts per meter per degree Centigrade), the thermal conductivity of the inner and outer layers in a circumferential direction about the gun tube is greater than the thermal conductivity of these layers in an axial direction. Thus, most of the heat from a hot spot in either the inner or outer layers is dissipated about the tube to reduce the temperature gradient across the tube rather than dissipated axially, which increases the portion of the gun barrel subject to bending stress due to the hot spot.

The bending stress on the gun barrel 14 produced by asymmetric thermal expansion or contraction of the inner or outer layers 42, 46 could also be minimized by forming these layers of annular aluminum pieces coated with or embedded in a thermally conductive flexible adhesive. However, since the gun barrel 14 is tapered along its length, each ring would have be specially formed to conform to the gun barrel. Thus, the forming of these layers by winding aluminum wire about the gun barrel is preferable, from an economic viewpoint.

Figure 15:
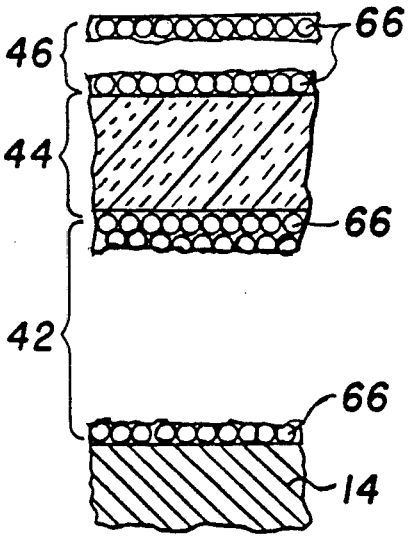
FIG. 15 is a partial sectional schematic view of a portion of another embodiment of the invention, similar to the embodiment of FIG. 13 except utilizing carbon filament in place of aluminum wire.

Other filaments or wires of high thermal conductivity material could be used in place of aluminum wire in forming the inner and outer layers 42, 46. If copper wire were used instead of aluminum, the weight of the shroud 40 would be greatly increased and the outer layer 42 would be much more susceptible to corrosion. However, the forming of the inner and outer layer 42, 46 by wrapping the gun barrel with layers of carbon filaments 66 rather than aluminum wire 48 appears attractive. Not only are carbon filaments good thermal conductors, but they are lightweight and have a low thermal coefficient of expansion. The use of such carbon filaments not only would provide inner and outer layers 42, 46 having circumferential thermal conductivity greater than an axial thermal conductivity, but also the thermal expansion or contraction of these layers would be much less than that of metallic layers. This embodiment is shown in FIG. 15.

The middle layer 44 may be formed of a flexible, thermally nonconductive adhesive which is applied as a foam so that when the adhesive is cured, it includes many closed cell air spaces which increases the thermal insulating characteristics of the layer 44 without increasing its weight. Also, the middle layer 44 may be formed as a honeycomb structure of corrogated insulating fiber material, such as Nomex, a polymer fiber manufactured by E. I. DuPont De Nemours and Company, Wilmington, Delaware, which is affixed by flexible adhesive to the inner and outer layers 42, 46.

Other possible embodiments of the invention include existing conventional shrouds which are modified to include an inner layer of thermally conductive material dispersed in intimate thermal contact with the gun barrel to reduce temperature gradients on the barrel caused by gun fire.

Since there are many variations, modifications, and additions to the invention which would be obvious to one skilled in the art, it is intended that this invention be limited only by the appended claims.

What is claimed and desired to be secured by Letters Patent of the United States is:

1. A thermal shroud for a gun tube having an axis, comprising:

a first or innermost layer, which consists of thermally conductive material in contact with the gun tube, including at least one thermally conductive filament which is wound about the gun tube and which is embedded in a thermally conductive flexible adhesive for maintaining the filament in thermal contact with the gun tube, wherein the thermal conductivity of the first layer in a circumferential direction about the periphery of the gun tube is greater than the thermal conductivity of the first layer in an axial direction; and at least one additional layer, including a second or next-to-innermost layer which consists of thermal insulation material in contact with the first layer.

2. A thermal shroud, as described in claim 1, wherein at least one filament comprises at least one carbon filament.

3. A thermal shroud, as described in claim 1, wherein at least one filament comprises at least one aluminum wire.

4. A thermal shroud, as described in claim 3, wherein each turn of aluminum wire is separated from any adjacent turn of aluminum wire by the flexible adhesive, to minimize any bending force exerted on the gun tube by the wound aluminum wire due to an asymmetric heat flux.

5. A thermal shourd, as described in claim 1, wherein the second layer comprises a flexible, thermally nonconductive adhesive.

6. A thermal shroud, as described in claim 5 wherein the second layer further comprises at least one layer of fiberglass cloth embedded in the flexible thermally nonconductive adhesive.

7. A thermal shroud for a gun tube having an axis, which comprises three concentric layers of material extending around the periphery of the gun tube, the three layers consisting of:

an inner layer of thermally conductive material in contact with the gun tube, wherein the thermal conductivity of the inner layer in a circumferential direction about the periphery of the gun tube is greater than the thermal conductivity of the inner layer in an axial direction;

a middle layer of thermal insulation material in contact with the inner layer; and an outer layer of thermally conductive material in contact with the middle layer wherein the thermal conductivity of the outer layer in a circumferential direction about the periphery of the middle layer is greater than the thermal conductivity of the outer layer in an axial direction.

8. A thermal shroud, as described in claim 7, wherein the outer layer comprises at least one carbon filament wound in a circumferential direction about the middle layer.

9. A thermal shroud, as described in claim 7, wherein the outer layer comprises at least one aluminum wire which is wound about the middle layer and which is embedded in a thermally conductive flexible adhesive.

10. A thermal shroud, as described in claim 9, wherein each turn of aluminum wire is separated from any adjacent run of aluminum wire by the flexible adhesive, to minimize any bending force exerted on the gun tube by the wound aluminum wire due to an asymmetric heat flux.

11. A thermal shroud for a gun tube having an axial bore and a bore evacuator which includes a plenum extending over a portion of the gun tube and a plurality of bore exhaust ports extending through the gun tube between the gun bore and the plenum, in which the thermal shroud comprises:

a first layer of thermally conductive material in contact with the portion of the gun tube disposed beneath the bore evacuator wherein the first layer includes at least one thermally conductive filament which is wound about the gun tube and which is embedded in a thermally conductive flexible adhesive for maintaining the filament in thermal contact with the gun tube and wherein the thermal conductivity of the first layer in a circumferential direction about the periphery of the gun tube is greater than the thermal conductivity of the first layer in an axial direction and wherein the first layer does not block or cover the plurality of bore exhaust ports.

12. A thermal shroud, as described in claim 11, which further comprises:

a second layer, which consists of thermal insulation material in contact with the first layer, the second layer extending over the portion of the first layer disposed beneath the bore evacuator; and a third layer, which consists of thermally conductive material in contact with the second layer, the third layer extending over the portion of the second layer disposed beneath the bore evacuator;

wherein the plurality of bore exhaust ports extends through the second and third layers.

13. A thermal shroud for a gun tube having an axis, comprising:

an inner layer of thermally conductive material in contact with the gun tube, wherein the thermal conductivity of the inner layer in a circumferential direction about the periphery of the gun tube is greater than the thermal conductivity of the inner layer in an axial direction along the gun tube axis, the inner layer including at least one thermally conductive filament which is wound about the gun tube and which is embedded in a thermally conductive flexible adhesive for maintaining the filament in thermal contact with the gun tube;

a middle layer of thermal insulation material in contact with the inner layer; and an outer layer of thermally conductive material in contact with the middle layer, wherein the thermal conductivity of the outer layer in a circumferential direction about the periphery of the middle layer is greater than the thermal conductivity of the outer layer in an axial direction along the gun tube axis, the outer layer including at least one thermally conductive filament which is wound about the middle layer and which is embedded in a thermally conductive flexible adhesive.

14. A thermal shroud, as described in claim 13, wherein the filament of at least one of the inner and outer layers is a carbon filament.

15. A thermal shroud, as described in claim 13, wherein the filament of at least one of the inner and outer layers is a metal wire.

* * * * *

UNITED STATES PATENT AND TRADEMARK OFFICE

CERTIFICATE OF CORRECTION

PATENT NO. : 4,841,836

DATED : June 27, 1989

INVENTOR(S) : Mark L. Bundy

It is certified that error appears in the above—identified patent and that said Letters Patent is hereby corrected as shown below:

Title page -- add Assignee: UNITED STATES OF AMERICA AS REPRESENTED BY THE SECRETARY OF THE ARMY, Washington, D.C.

Signed and Sealed this

Sixth Day of November, 1990

*Attest:*

HARRY F. MANBECK, JR.

*Attesting Officer*

*Commissioner of Patents and Trademarks*